United States Patent [19]

Peterson et al.

[11] Patent Number: 5,072,929

[45] Date of Patent: Dec. 17, 1991

[54] DUAL RESISTANCE EXERCISE ROWING MACHINE

[75] Inventors: Stephen S. Peterson, Maple Grove; Harold C. Blawd, Burnsville; Michael E. Heutmaker, Long Lake; Timothy S. Engel, Bloomington; Robert A. Iverson, Eden Prairie, all of Minn.

[73] Assignee: Nordictrack, Inc., Chaska, Minn.

[21] Appl. No.: 537,898

[22] Filed: Jun. 13, 1990

[51] Int. Cl.[5] ..... A63B 69/06; A63B 21/018

[52] U.S. Cl. ..... 272/72; 272/73; 272/129; 310/105

[58] Field of Search ..... 272/72, 129, 73, 132, 272/14, 126, 120, 69, DIG. 4, 58, 130

[56] References Cited

U.S. PATENT DOCUMENTS

| | | | |
|---|---|---|---|
| 1,139,126 | 5/1915 | Kerns | 272/140 |
| 1,750,549 | 11/1927 | Thomson | 272/72 |
| 1,866,860 | 7/1932 | Pareira | 272/72 |
| 4,023,795 | 5/1977 | Pauls | 272/97 |
| 4,541,627 | 9/1985 | MacLean | 272/72 |
| 4,728,102 | 3/1988 | Pauls | 272/132 |
| 4,795,147 | 1/1989 | Seal | 272/72 |
| 4,798,378 | 1/1987 | Jones | 272/72 |
| 4,867,447 | 9/1989 | Johnson | 272/72 |
| 4,953,415 | 9/1990 | Lehtonen | 272/72 |

OTHER PUBLICATIONS

Exhibit A, X-Oarcizer advertisement, by Martin Marine Company, Inc.

Exhibit B, Liferower Model 8500 advertisement, by Life Fitness Inc.

Exhibit C, Anatomy of a WaterRower Brochures, by WaterRower Inc.

Exhibit D, The Concept II Rowing Ergometer brochures, by Concept II, Inc. dated 1990.

Exhibit E, The Dynamics of Rowing on an Altero 503 Rower Brochure, by Altero Technologies Inc.

Exhibit F, Avita Paraflex II The Power Center advertisement, by Avita.

Exhibit G, R701 Air Rower brochures, by Tunturi, Inc. dated 1989.

*Primary Examiner*—Richard J. Apley

*Assistant Examiner*—Jerome Donnelly

*Attorney, Agent, or Firm*—Merchant, Gould, Smith, Edell, Welter & Schmidt

[57] ABSTRACT

Disclosed is a rowing machine (10) having two resistance mechanisms or flywheels (44, 49). The dual resistance is applied through the movable handle (19) and movable seat (12). The handle (19) is interconnected by means of a cord (28) to the first flywheel (44), and the seat (12) is interconnected by means of a cord (29) to the second flywheel (49). The seat (12) is mounted upon an inclined track (11) and is anatomically contoured. The resistance mechanisms (44, 49) are adjusted by means of drag straps (53, 54) and an adjuster (55). The inclination of the track (11) and the position of the foot plates (23) is adjustable.

10 Claims, 4 Drawing Sheets

DUAL RESISTANCE EXERCISE ROWING MACHINE

FIELD OF THE INVENTION

The invention relates generally to exercise apparatus and more particularly to a rowing machine type of exercise apparatus having two independent resistance mechanisms which exercise the upper and lower body respectively.

BACKGROUND OF THE INVENTION

Rowing machines are a type of exercise equipment intended to duplicate the rowing stroke of a boat in water. With conventional rowing machines, the resistance of the water is simulated in various ways, for example, hydraulic or pneumatic cylinder assemblies or wind fan assemblies. Typically, the rowing machine has a handle or a pair of pivoted rowing arms which the user pulls towards his body, and a slidable seat which moves back and forth upon a track as the arms are moved against the force of the resistance mechanism. With these rowing machines, only a single resistance mechanism is applied through the arms.

There are several drawbacks to these conventional rowing machines. Because the machine's resistance is applied through the arms, the force of the resistance travels through the arms and down through the rower's back. As a consequence, the energy which the user expends and the length of the workout is limited by the strength of the rower's arms and back, which are often one of the weakest areas of the body. Accordingly, the user's cardiovascular and strength workout is somewhat limited. Alternatively, if the user uses a conventional rowing machine at too high of an exercise level, it is likely that injury to the back or muscle strain may result. Risk of back injury or strain is compounded by the fact that conventional hydraulic rowing machines are typically designed so that it is often necessary for the user to pull upwardly on the handles at the beginning of each stroke.

Many conventional rowing machines are also relatively large and cumbersome in design. For example, for rowing machines which employ a wind fan assembly, the wind fan is located on one end of the rowing machine track, thereby resulting in a relatively long exercise device which requires a great deal of space. Also, past attempts with flywheel-type resistance mechanisms have resulted in flywheels of extremely heavy weight, thereby making the exercise device difficult to move for storage or other purposes. Conventional rowing machine exercisers are also problematic because of the high level of noise which is generated when in use.

The present invention addresses these and many other problems associated with currently available rowing machine exercisers.

SUMMARY OF THE INVENTION

The present invention is an exercise apparatus, comprising a seat which is slidably mounted upon a track, a first resistance means against which the rower applies force by pulling a handle, and a second resistance means against which a rower applies force by pushing against the seat and a stationary foot plate. In the preferred embodiment, the two resistance mechanisms are flywheel assemblies, each of which has a one-way clutch drive means and a recoil spring. The two resistance mechanisms are adjustable according to the strength and endurance of the rower. Preferably, the resistance is adjusted by adjusting the frictional drag of a brake band or dragstrip which is positioned around each flywheel.

The rowing machine provides exercise for most of the major muscle groups in the arms, back, hips, legs, shoulders and torso. A primary advantage of the present invention is that it allows the user to obtain a better cardiovascular workout and to build strength and endurance while at the same time minimizing the risk of muscle strain and injury. This is because the adjustable dual resistance mechanisms allow resistance to be applied independently against the user's arms and legs, and to be adjusted to levels suitable for the user's relative physical fitness condition. Because the leg muscles are the strongest muscles of a human body, application of stronger resistance against the legs results in a greater aerobic and strength workout for the user, and more calories are burned than with conventional rowing machines in which leg resistance is limited by the strength of the user's back and arms. In addition, the application of force to the legs separate from the arms greatly minimizes the risk of injuries and muscle strain, especially in the user's back area. Consequently, the cardiovascular, conditioning and calorie burn rate benefits associated with a workout can be maximized while simultaneously minimizing the risk of injuries or muscle strain.

Another advantage of the rowing machine of the present invention is that it is easy to use. The rowing machine's seat is elevated somewhat above floor level, so that a user with limited flexibility need not squat completely to floor level in order to utilize the device. The level of the foot plates is adjustable to a level below the level of the rowing machine's seat and frame, thereby allowing the rower to assume a more comfortable, less awkward position than is possible with conventional, rowing machines. Further, the inventive rowing machine is provided with design features which facilitate a smooth, continuous movement back and forth during the exercise process. Specifically, the downward incline of the main track frame and the presence of a recoil spring within the resistance mechanism device allow the rower to return easily to the "start" position to begin the drive portion of the stroke.

Yet another advantageous feature of the present invention is that it is adjustable for users of different sizes and exercise abilities. The level of resistance for either the legs or arms is easily and independently adjustable, so that the rowing machine can accommodate different users, and so that the same user can progress with increasingly challenging workouts, if desired. In addition, the incline of the rowing machine can be adjusted according to the size and comfort of the user, as can the position of the foot plates. Furthermore, the invention can be utilized to provide a workout for only the legs or only the arms, instead of both simultaneously, because the two resistance mechanisms can operate completely independently. However, it is preferable for the rower to utilize both resistance mechanisms simultaneously, in order to fully benefit from the exercise features of the inventive rowing machine.

Another advantage of the present invention is that it is relatively compact and lightweight. The resistance mechanism is designed to fit beneath the main track portion of the rowing machine, so that the length of the machine is essentially limited to the length of the track itself. In addition, the rowing machine is relatively lightweight, because the dual resistance system, in the preferred embodiment, is designed to operate with relatively lightweight flywheels at high revolutions per minute. The compact size and weight of the rowing machine thus make it convenient and easy to move for the user. The aesthetic design of the rowing machine is also pleasing enough to enhance any home or exercise club decor. Another advantageous feature is that the inventive rowing machine is significantly less noisy than conventional rowing machines, making it less intrusive in home, health club and institutional settings.

For a better understanding of the invention, and of the advantages obtained by its use, reference should be made to the drawing and the accompanying descriptive matter in which there is illustrated and described a preferred embodiment of the invention.

BRIEF DESCRIPTION OF THE DRAWINGS

Referring particularly to the drawings, wherein like reference numerals indicate like parts throughout the several views.

DETAILED DESCRIPTION OF THE PREFERRED EMBODIMENT

Figure 1:
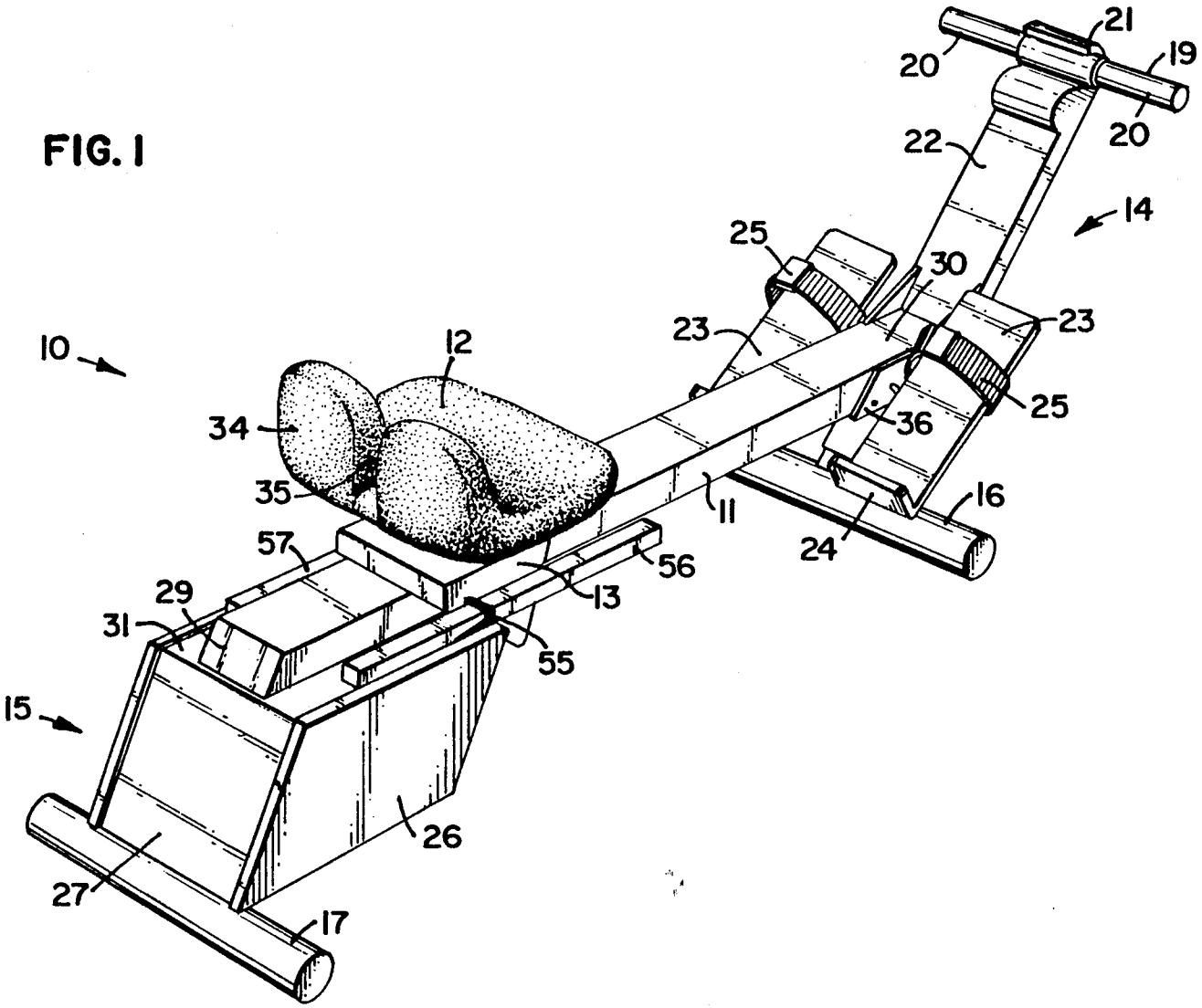
FIG. 1 is a perspective view of the rowing machine of the present invention.
Figure 2:
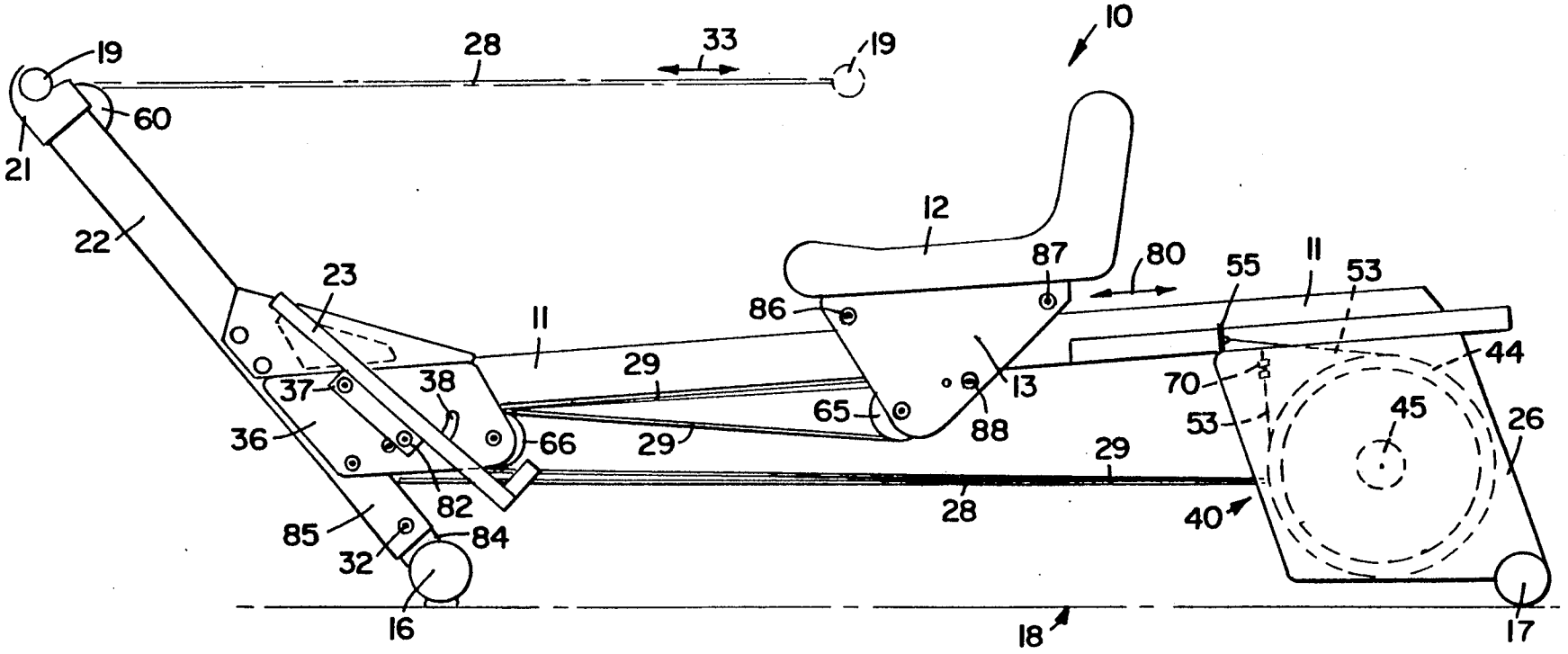
FIG. 2 is a side elevational view of the rowing machine shown in FIG. 1.

Referring to FIGS. 1 and 2, the exercise rowing machine 10 of the present invention is illustrated. The exercise rowing machine 10 has a longitudinal center track 11 upon which a seat 12 and seat carriage 13 are slidably mounted. The forward end 14 and rear end 15 of the exercise apparatus 10 have suitable cross members 16, 17 respectively for structural support of the rowing machine 10. The cross members 16, 17 provide stability to the exercise apparatus 10 and allow the exercise machine 10 to resist any rocking motion.

The seat 12 and track 11 are, in the preferred embodiment, positioned approximately one to two feet above the level of the support floor 18, most preferably seventeen (17) inches above floor level 18. This design enables a user to position himself upon the exercise apparatus 10 without squatting to floor level 18, as is common with conventional rowing machines. It also makes it easier for the rower to easily assume a standing position after a strenuous workout. The length of the track or rail 11 is sufficient to allow ample seat travel for the tallest rowers. The track 11 provides a smooth running surface for the seat carriage 13, and the rail 11 is preferably made of steel tubing, approximately two by four inches in size.

At the forward end 14 of the exercise machine 10 is an oar handle 19. The handle 19 may be provided with a pair of textured hand grips 20. A slot 21 in the front column 22 is provided for accommodating of the handle 19 when the exercise machine 10 is not being used. The slot member 21 is preferably made of a plastic material. A pair of foot plates 23 are provided for positioning of the rower's feet Preferably, the foot plates 23 have heel rests 24 and foot straps 25 to secure the rower's feet against the foot plates 23. The handle 19 and corresponding cord 28 is pulled in a horizontal direction back and forth, as indicated by the arrow 33 in FIG. 2. The seat 12 slides back and forth along the track, as illustrated by the arrow 80.

Figure 3:
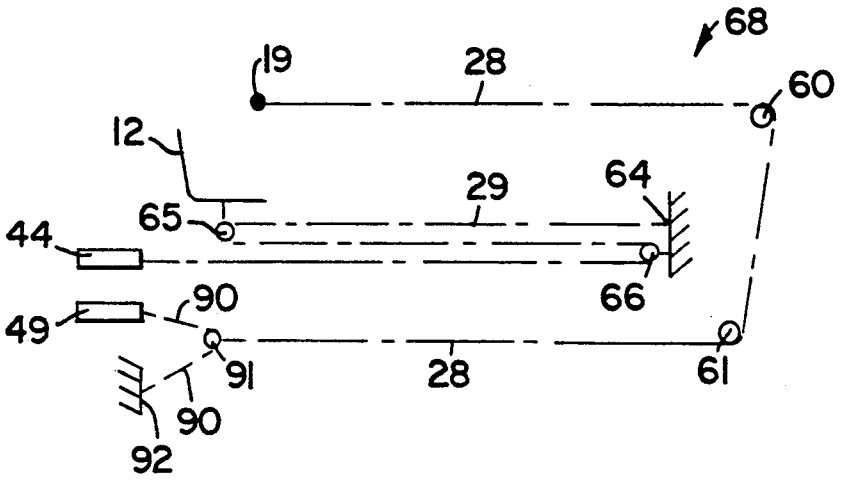
FIG. 3 is a schematic view of the preferred pulley routing system employed with the present invention.

The exercise apparatus 10 has two resistance mechanisms or resistance means which provide exercise for both the upper and lower body respectively. That is, a first resistance means is interconnected to the handle 19, so that a user pulling upon the handle 19 must apply force against the resistance of the first resistance means. A second resistance means is interconnected to the seat 12, so that a user pushing against the foot plates 23 must apply force against the resistance of the second resistance means. The two resistance mechanisms are, in the preferred embodiment, interconnected to the handle 20 and seat 12 by a first cord 28 and second cord 29, as shown in FIGS. 2 and 3. The resistance means may take various forms, such as a flywheel assembly, a centrifugal clutch assembly, a hydraulic or pneumatic cylinder assembly, or other means well known in the art.

Preferably, the first and second resistance means are positioned at the rear end 15 of the machine 10, below the track 11, and a plurality of side, back and upper panels 26, 27, 31 form a housing for the first and second resistance means. In the preferred embodiment, the two resistance mechanisms comprise two independent flywheel assemblies, as will be explained in greater detail below.

Figure 5A:
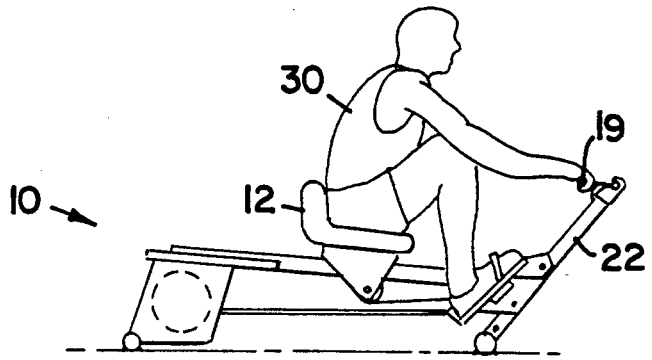
FIGS. 5A-5C are side views of the various positions of the rower while utilizing the rowing machine of the present invention.
Figure 5B:
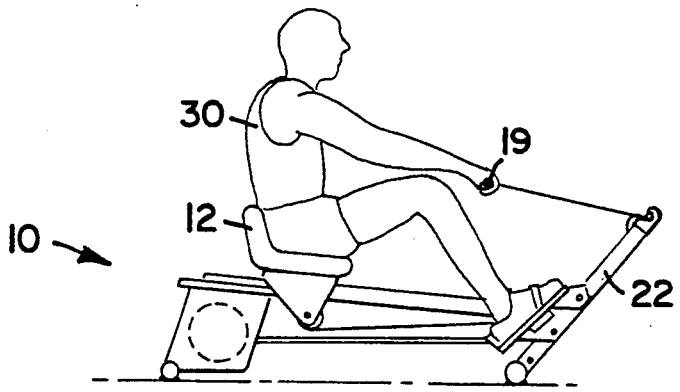
Figure 5C:
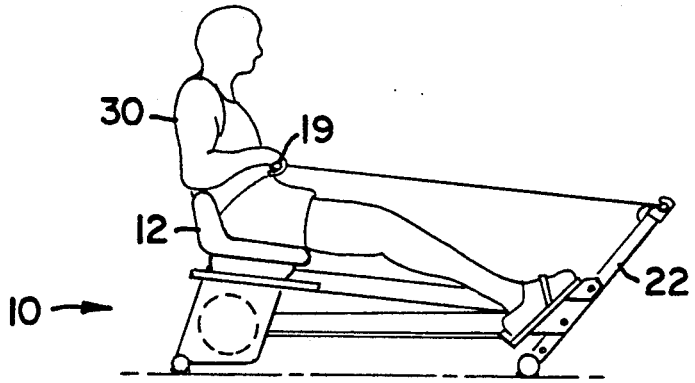

FIGS. 5A-C illustrate the drive portion and recovery portion of each stroke while the rower uses the exercise machine 10. As is illustrated in FIG. 5A, the rower 30 assumes a starting position in which the seat 12 is toward the forward end 14 of the machine 10. The rower simply pulls the handle 19 back toward him horizontally, unlike many conventional rowing machines in which the initial pull must be in an upward direction, thus causing a potential for back strain. As the user 30 works through the stroke, the leg muscles work against the second resistance mechanism, whereas the upper body muscles work against the resistance of the first resistance mechanism. As shown in FIG. 5B, the rower 30 maintains a substantially upright position throughout the stroke, and pulls the handle 19 horizontally toward the mid-section of his body. The completion of the stroke is illustrated in FIG. 5C, wherein the user's legs are extended and the seat 12 is proximate the rear end 15 of the machine 10. The rower then returns to the starting position shown in FIG. 5A.

In the preferred embodiment, the track 11 is inclined, so that the forward end 30 of the track 11 is approximately one to two inches below the rear end 29 of the track 11, as is best illustrated in FIG. 2. This inclination angle of the track 11 facilitates return of the seat 12 to the starting position, and provides a balanced exercise motion which simulates a smooth, continuous rowing motion. The rear end 29 of the track is suitably mounted upon the upper support panel 31 which forms a part of the resistance mechanism housing. The forward end 30 of the rail 11 is preferably welded to the support column 22. The support column 22 is formed of two telescoping steel tubular members, an inner member 84 and an outer member 85. The relative position of the tubes 84, 85 can be moved so as to change the height of the support member 22 and therefore the inclination of the track 11. The position of the telescoping support member 22 is secured via suitable means such as reset bolts 32. The inclination angle of the track 11 can be adjusted according to the size and comfort of the rower, or in order to work different muscle groups during the rowing machine exercise. The inclination angle of the track 11 is at a middle position as illustrated in FIG. 2. In the preferred embodiment, the angle of inclination is adjustable between approximately one and one-half degrees and five and one-half degrees from horizontal.

The seat 12 and seat carriage 13 are slidably mounted upon the track 11 for smooth, continuous back and forth movement. In the preferred embodiment, a plurality of rollers (not shown) beneath the carriage frame 13 ride upon the track 11. The rollers (not shown) may be covered with a suitable elastomeric or soft plastic material that has a reasonably soft durometer, and reduces the noise of the machine 10 when in use. In the preferred embodiment, two rollers are mounted beneath the seat 12 in suitable bearings 86, 87 in the seat carriage 13. These rollers ride upon the upper surface of the track 11. In addition, there is a lower roller (not shown), mounted to the lower portion of the seat carriage 13 at bearing mount 88, the lower roller riding against the underside of the track 11. It is to be understood that alternative sliding mechanisms could be easily devised by those skilled in the art.

The seat 12 is anatomically contoured so as to provide a comfortable seat for the rower 30. The seat 12 is cushioned and is preferably made of a high-density resilient foam material which has been molded around an L-shaped steel insert (not shown). In the preferred embodiment, the seat 12 includes a rear support portion 34, which provides support for the rower's lower back. The user's hips exert leg-thrust directly onto the rear support portion 34. In addition, the rear support portion 34 preferably has a vertical groove 35, which accommodates the tailbone and spine of the rower, so as to relieve pressure and reduce potential for back strain or injury. The back portion 34 is preferably approximately 90 to 103 degrees with respect to the horizontal seat 12. The base of the seat 12 also preferably has a pair of depressions (not shown) which serve to relieve excess pressure upon the rower's pelvic bone during use of the rowing machine 10.

In the preferred embodiment, the heel rests 24 of the foot plates 23 are several inches below the level of the track 11 and seat 12. This allows the user to assume a more comfortable position while utilizing the exercise machine 10, especially when the rower 30 is in the starting position illustrated in FIG. 5A. The foot plates 23 are mounted upon suitable support brackets 36 on each side of the rail member 11. In the preferred embodiment, each foot plate 23 is able to swivel about pivot point 37, thereby enabling the foot plates 23 to rotate as the rower moves back and forth. That is, as the rower gets near the starting position on FIG. 5A, the foot plate 23 rotates slightly in a counterclockwise direction, as viewed in FIG. 2, so that the rower can flatten his feet as he moves forward. This swiveling ability of the foot plates 23 serves to reduce strain on the ankles and lower legs of the rower. The amount by which the foot plates can be rotated is limited by a cutout 38 in the plate 36, which serves as a stop.

In the preferred embodiment, the position of the foot plates 23 is adjustable by moving the foot plate bolts 37, 82 to different bolt holes (not shown) on the plates 36. The alternate position of the foot plates 23 is also provided with a stop (not shown). In the preferred embodiment, the foot plate angle is movable from approximately 45 degrees (the position shown in FIG. 2) to 30 degrees (when the rower is in the starting position illustrated in FIG. 5A), with respect to horizontal. When the foot plates 23 are in the alternate position, they are rotatable between a 30 degree configuration and 10 degree configuration. The position of the foot plates 23 can be varied according to the rower's flexibility, and different positions of the foot rests 23 provides a different type of strength workout to various muscle groups.

In the preferred embodiment, the housing side panels 26 and the foot plates 23 have a veneer of a wood material, which provides for an aesthetically pleasing appearance. The side panels' wood veneer is held in place to the underlying frame structure by bolts so as to provide additional structural support.

Figure 4:
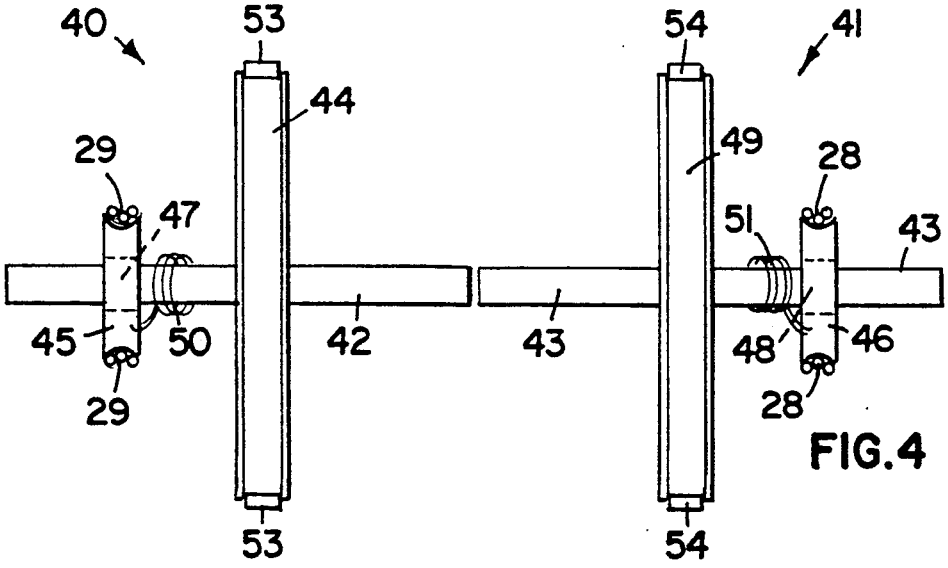
FIG. 4 is a side view of the preferred flywheel resistance mechanism utilized with the present invention.

As illustrated in FIGS. 2 and 4, the exercise apparatus 10 has a first resistance means or a flywheel assembly 40, and a second resistance means or flywheel assembly 41. Each resistance mechanism 40, 41 has an independently rotatable cross shaft 42, 43 respectively. The shafts 42, 43 are positioned within suitable bearing mounts in the resistance mechanism support structure. That is, the outer ends of the shafts 42, 43 are mounted within the framework side panels 26, and the inner ends of the shafts 42, 43 are mounted within an intermediate frame member (not shown). In the preferred embodiment, the resistance mechanisms 40, 41 are identical in construction.

Upon each shaft 42, 43 is mounted a flywheel 44, 49 respectively. The flywheels 44, 49 are preferably mounted upon the axles 42, 43 by means of a U-bolt arrangement (not shown). Also mounted upon each shaft 42, 43 is a cord drum 45, 46. The two cord drums 45, 46 accommodate winding of the seat cord 29 and handle cord 28 respectively. The cord drums 45, 46 are connected to the shafts 42, 43 respectively through one-way clutches in their hubs, which are illustrated schematically at 47, 48. The one-way clutches can be any desired type of one-way clutch which permits the cord drums 45, 46 to drive the shafts 42, 43, but only when the cord drums are driven in one direction. When the one-way clutches are installed so that when the cord drums are driven in a clockwise direction as viewed in FIG. 2, the cord drums or pulleys 45, 46 will tend to drive the shafts 42, 43 respectively in such clockwise direction. However, when the cord drums 45, 46 are moved in a counter-clockwise direction, as viewed in FIG. 2, the pulleys 45, 46 will free wheel and not drive the shafts 42, 43. Thus, the one-way clutches 47, 48 provide free wheeling action when the rope drums 45, 46 are moved counter-clockwise. Other suitable one-way drive means can be utilized if desired. Also, as stated above, the flywheels 44, 49 can be eliminated if a suitable friction device or other energy dissipation device is provided instead of the flywheels. For example, a pair of centrifugal clutch mechanisms could be provided for purposes of frictional resistance instead of the flywheels 44, 49. When the one-way clutch 47, 48 drives the shaft 42, 43, this will tend to rotate the corresponding flywheel 44, 49, storing the energy that is expended by the movement of the rower's arms or legs.

In the preferred embodiment, each cord drum 45, 46 is interconnected to a torsional spring 50, 51. Each torsional spring 50, 51 serves as a biasing means for biasing the shafts 42, 43 in a clockwise direction, as illustrated in FIG. 2. Thus, the torsional or recoil springs 50, 51 serve to rewind the cord 28, 29 onto the drums 45, 46 during the return (forward) stroke. In addition, the springs 50, 51 facilitate the recovery portion of the stroke and the return of the rower to the starting position, so that the rower need not pull himself forward with his legs in an unnatural motion.

In operation, pulling on the cord 28 or 29 causes the corresponding flywheel 49 or 44 to rotate, thereby creating resistance. The faster the flywheel rotates, the more work or power is expended. The momentum of the spinning flywheels 44, 49 carries the rower from stroke to stroke, resulting in a continuous, thorough workout. During the drive portion of each stroke, the rower causes the flywheels 44, 49 to rotate faster, and the cords 28, 29 are unwound. The force of the rower's drive stroke pulls against the torsional springs 50, 51. During the recovery part of the stroke, the one-way clutch does not engage, thereby causing the flywheels 44, 49 to continue spinning and allowing the cords 28, 29 to wind around their respective cord drums 45, 46.

In the preferred embodiment, frictional brake means are provided for frictionally restraining motion of the flywheels 44, 49. Preferably, the friction brake means comprises drag straps 53, 54 which form a band around the flywheels 44, 49 respectively and thereby increase the friction drag on each flywheel. The drag straps 53, 54 are preferably made of a woven polyester material. One end of each drag strap is attached to a stationary frame member by suitable attachment means, with a linear spring 70 being provided proximate the fixed end, as shown in FIG. 2. The amount of force or energy required to rotate the flywheel 44 or 49 can be changed by adjusting the drag of the brake band 53 or 54. In the preferred embodiment, the resistance adjustment means comprises a buckle member 55 (see FIG. 2), the two buckle members 55 being slidably mounted upon tubes 56, 57 on each side of the track 11. Forward movement of the adjuster 55 results in increased tension on the corresponding drag strap 53, 54, thereby increasing the drag resistance on the flywheel 44, 49. The spring 70 places tension upon the drag strap 53 or 54 and allows the resistance to be adjusted when the adjuster 55 is moved along the tube 56 or 57. This feature allows the rower to adjust the resistance level according to his or her strength or endurance.

In the preferred embodiment, the two resistance mechanism assemblies are positioned beneath the track 11 so as to enable the exercise apparatus 10 to be relatively compact in size. Preferably, a cord and pulley system is utilized to transfer the energy from the handle 19 or seat 12 to the respective resistance mechanism. The cords 28, 29 are preferably made of a nylon material. FIG. 3 is a schematic view of an exemplary pulley routing drive assembly 68. With respect to the interconnection of the oar handle 19 to the flywheel 49 and rope drum 28, there is a pulley 60 proximate the upper portion of the support column 22, the cord 28 extending through the hollow, tubular support member 22 and around a pulley 61 proximate the bottom end of the support column 22. The cord 28 then extends to a pulley 91, the end of the rope 28 being attached to the pulley 91 by means of a pulley bracket (not shown). A separate cord 90 is wound around the pulley 91. One end of the cord 90 is attached to a stationary frame member 92, the other end of the cord 90 being attached to the cord drum 46.

With respect to the interconnection of the seat 12 with its resistance assembly 44, one end of the cord 29 is fixed at point 64, proximate the front end 14 of the apparatus 10. The cord 29 extends around a pulley 65 attached to the bottom portion of the seat carriage 13, and then around a second pulley 66 proximate the forward end of the exercise machine 10. The cord 29 then extends back to the rear of the machine and around the rope drum 45 which corresponds to flywheel 44. It is to be understood that alternative pulley routing arrangements could be readily devised. In the preferred embodiment, the drive assembly, 68 is not direct drive; rather, the pulley ratio is closer to 2:1, as is illustrated with the exemplary system of FIG. 3. The higher pulley ratio causes a higher revolution per minute rate for the flywheels, and therefore allows smaller diameter flywheels 44, 49 to be utilized. The pulleys are mounted upon suitable ball bearings for a smooth, quiet transmission of power.

An optional feature of the present invention is a microprocessor-controlled performance monitor (not shown) which can provide the rower with speed, rowing cadence, distance and similar data and/or graphics.

It is to be understood that numerous and various modifications can be readily devised in accordance with the principles of the present invention by those skilled in the art without departing from the spirit and scope of the invention. It is not desired to restrict the invention to the particular construction illustrated and described but to cover all modifications that may fall within the scope of the appended claims.

What s claimed is:

1. An exercise apparatus, comprising:

(a) a seat slidably mounted upon an inclined track having a forward end and a rear end, the track being inclined at an angle;

(b) a first flywheel resistance means interconnected to a handle, wherein a user pulling upon said handle applies force against resistance of said first flywheel resistance means;

(c) a second flywheel resistance means interconnected to said seat, wherein a user pushing against a foot plate and said seat applies force against resistance of said second flywheel resistance means;

(d) means for adjusting the resistance of said first and second flywheel resistance means; and (e) a support column, the support column being affixed to the track and extending between the track and a horizontal support surface, said support column being configured to support said handle, the support column further comprising:

(i) an inner member, the inner member having a first outer dimension, the inner member being formed so as to have a plurality of diametrically opposed orifices passing through the inner member;

(ii) an outer member, the outer member having a second inner dimension, the second inner dimension being greater than the first outer dimension, the outer member being formed so as to have a plurality of diametrically opposed orifices passing through the outer member, the inner member being slidably positionable within the outer member, the inner member being adjustably secured to the outer member by means of at least one shafted fastener passing through at least one pair of aligned orifices on the inner and outer members, thereby establishing a lengthwise dimension of the support column and the angle of inclination of the track;

2. The exercise apparatus according to claim 1, wherein said flywheel assemblies include one-way drive means.

3. The exercise apparatus according to claim 1, wherein said seat includes a rear support portion.

4. The exercise apparatus according to claim 1, further comprising friction brake means for fictionally restraining motion of said first and second flywheel assemblies.

5. The exercise apparatus according to claim 4, wherein said friction brake means comprises a dragstrap and said resistance adjustment means comprises a buckle attached to said dragstrap and slidably mounted upon a frame member of said exercise apparatus, wherein the position of said buckle controls a restraining force of said dragstrap.

6. The exercise apparatus according to claim 5, wherein said foot plate is mounted upon a support frame of said exercise apparatus and are pivotable, the position of said foot plates upon said support frame being adjustable.

7. The exercise apparatus according to claim 6, wherein said seat is elevated approximately one foot from floor level.

8. The exercise apparatus according to claim 7, wherein a shaft upon which said flywheel resistance means is mounted includes a torsional spring for biasing said apparatus toward a starting position.

9. A rowing machine exercise apparatus, comprising:

(a) a seat having a rear support portion, said seat being slidably mounted upon an inclined track having a forward end and a rear end, wherein said track is positioned at a level above floor level and a first and second foot plate is pivotably mounted below the level of said track such that each foot plate is able to swivel about a pivot point, the extent of the pivoting motion being adjustable;

(b) a first shaft member rotatably mounted on said frame, a first one-way clutch means, a first flywheel and a first torsional spring mounted on said shaft, said first flywheel being interconnected to a handle by means of a first cord;

(c) a second shaft member rotatably mounted on said frame, a second one-way clutch means, a second flywheel, and a torsional spring being mounted on said shaft, said second flywheel being interconnected to said seat by means of a second cord; and (d) a support column, the support column being affixed to the track and extending between the track and a horizontal support surface, said support column being configured to support said handle, the support column further comprising:

(i) an inner member, the inner member having a first outer dimension, the inner member being formed so as to have a plurality of diametrically opposed orifices passing through the inner member;

(ii) an outer member, the outer member having a second inner dimension, the second inner dimension being greater than the first outer dimension, the outer member being formed so as to have a plurality of diametrically opposed orifices passing through the outer member, the inner member being slidably positionable within the outer member, the inner member being adjustably secured to the outer member by means of at least one shafted fastener passing through at least one pair of aligned orifices on the inner and outer members, thereby establishing a lengthwise dimension of the support column and the angle of inclination of the track; and (e) resistance adjustment means for adjusting resistance of said first and second flywheels such that a person residing in the seat may engage in a reciprocating rowing motion, each foot plate being rotatable within present limits as the person moves back and forth along the inclined track.

10. An exercise apparatus, comprising:

(a) a seat slidably mounted upon an inclined track having a forward end and a rear end, the track being inclined at an angle;

(b) a first flywheel resistance means interconnected to a handle, wherein a user pulling upon said handle applies force against resistance of said first flywheel resistance means;

(c) a second resistance means interconnected to said seat, wherein a user pushing against a foot plate and said seat applies force against resistance of said second resistance means;

(d) means for adjusting the resistance of said first and second flywheel resistance means; and (e) a support column, the support column being affixed to the track and extending between the track and horizontal support surface, said support column being configured to support said handle, the support column further comprising:

(i) an inner member, the inner member having a first outer dimension, the inner member being formed so as to have a plurality of diametrically opposed orifices passing through the inner member;

(ii) an outer member, the outer member having a second inner dimension, the second inner dimension being greater than the first outer dimension, the outer member being formed so as to have a plurality of diametrically opposed orifices passing through the outer member, the inner member being slidably positionable within the outer member, the inner member being adjustably secured to the outer member by means of at least one shafted fastener passing through at least one pair of aligned orifices on the inner and outer members, thereby establishing a lengthwise dimension of the support column and the angle of inclination of the track.

* * * * *

UNITED STATES PATENT AND TRADEMARK OFFICE

CERTIFICATE OF CORRECTION

PATENT NO. : 5,072,929

DATED : December 17, 1991

INVENTOR(S) : Peterson et al.

It is certified that error appears in the above-identified patent and that said Letters Patent is hereby corrected as shown below:

Column 4, line 61, "is " should read -- is --.

Column 3, line 68, insert -- . -- after the word "feet".

Claim 4, Column 9, line 7, "fictionally" should read -- frictionally --.

Claim 6, Column 9, line 19, "are" should read -- is --.

Claim 8, Column 9, line 27, "includes" should read -- to include --.

Claim 9, Column 9, line 48, delete "and" after the word "cord;".

Claim 9, Column 10, line 19, "present" should read -- preset --.

Claim 10, Column 10, line 34, delete "flywheel" after the word "second".

Claim 6, Column 9, line 20, delete "plates" and substitute --plate--.

Signed and Sealed this

Sixth Day of April, 1993

*Attest:*

STEPHEN G. KUNIN

*Attesting Officer*

*Acting Commissioner of Patents and Trademarks*